US005332219A

United States Patent [19]

Marnell, II et al.

[11] Patent Number: 5,332,219

[45] Date of Patent: Jul. 26, 1994

[54] APPARATUS AND METHOD FOR PLAYING AN ELECTRONIC POKER GAME

[75] Inventors: Anthony A. Marnell, II; Cary A. Rehm, both of Las Vegas, Nev.

[73] Assignee: Rio Properties, Inc., Las Vegas, Nev.

[21] Appl. No.: 957,772

[22] Filed: Oct. 8, 1992

[51] Int. Cl.[5] ..... A63F 1/00

[52] U.S. Cl. ..... 273/138 A; 273/85 G; 273/85 CP; 364/412

[58] Field of Search ..... 273/85 CP, 85 G, 138 A, 273/262, 269; 364/412

[56] References Cited

U.S. PATENT DOCUMENTS

| | | | |
|---|---|---|---|
| 4,314,336 | 2/1982 | Bernstein et al. | 273/85 CP |
| 4,570,934 | 2/1986 | Smyth | 273/138 A |
| 4,799,683 | 1/1989 | Bruner, Jr. | 273/138 A |
| 4,948,134 | 8/1990 | Suttle et al. | 273/85 CP |
| 5,019,973 | 5/1991 | Wilcox et al. | 364/412 |
| 5,042,818 | 8/1991 | Weingardt | 273/292 |
| 5,100,137 | 3/1992 | Fulton | 273/85 CP |
| 5,141,234 | 8/1992 | Boylan et al. | 273/306 |
| 5,188,363 | 2/1993 | Marnell, II et al. | 273/85 CP |

FOREIGN PATENT DOCUMENTS 2169736 7/1986 United Kingdom ..... 273/85 CP

*Primary Examiner*—V. Millin
*Assistant Examiner*—Kerry Owens

[57] ABSTRACT

An electronic poker game apparatus (10) including user-actuated input members (22) and an electronic game control device (42) electrically connected to input members (22) and responsive to user input to simulate play of a poker game. The game control device (42) generates a plurality of signals representing randomly selected cards from a deck of cards to create a poker hand. A bonus signal generator (52) electrically communicates with the game control device (42) and responds to the selection of a predetermined signal representing a predetermined card to randomly effect one of: (i) replacing the predetermined signal with a bonus signal and (ii) retaining the predetermined signal in accordance with odds less than unity. A display screen (16), which is electrically connected to the game control device (42), displays card symbols corresponding to the randomly selected signals and the bonus signal, if present, to indicate progress of the poker game.

8 Claims, 3 Drawing Sheets

APPARATUS AND METHOD FOR PLAYING AN ELECTRONIC POKER GAME

FIELD OF THE INVENTION

This invention relates to a novel electronic gaming apparatus and an associated method of play. More specifically, this invention relates to an electronic apparatus and method for playing a poker game which provides an opportunity to win bonus winnings.

BACKGROUND ART

In recent years numerous electronic gaming devices have been devised for playing gambling games, such as roulette, keno, poker, bingo, lotto and the like. Such electronic gaming apparatus are generally constructed in a conventional slot machine format. These gaming apparatus include a microprocessor which serves as the game controller. The microprocessor typically is connected to an image generator which electronically simulates cards and/or symbols, depending on the game, on a video screen. In general, the microprocessor randomly selects cards or symbols for play of the game and, at the end of the game, determines whether the player is entitled to winnings.

In order to enhance player enjoyment, a number of these electronic gaming apparatus have been modified to include additional playing cards or symbols not normally present in a conventional game. For example, electronic gaming apparatus which simulate reel-type slot machines may include certain designated symbols which award relatively high winnings. In such electronic slot machines, symbols carried on an electrically simulated, rotatable reel include traditional slot machine symbols, such as cherries, bells, plums, and the like, as well as a special designated symbol, such as a casino logo, worth more than the other symbols present on the simulated reel. If three casino logos are present in a winning spin, the player may receive a bonus value jackpot. Adding special designated symbols to conventional slot machines essentially has been used to create new game winning combinations which award a different, usually higher, value.

Electronic poker gaming apparatus also have been devised in the past which include wild cards in addition to the fifty-two playing cards found in a standard deck. A player generally may use these wild cards to represent a card of any value and of any suit. These electronic poker gaming apparatus typically include a microprocessor which randomly selects cards from an electronic deck for play of a poker game. The wild cards are included in the random selection process performed by the microprocessor. So, the probability of a player receiving a wild card directly depends on how many cards are present in the deck at the time of the random card selection.

In such prior poker gaming apparatus, the winnings awarded to a player corresponds to the winning combination of cards in the hand, with a Royal Flush typically paying the most and a pair paying the least, depending upon the pay table and whether or not there are wild cards. The winnings awarded to a player are the same whether or not the winning combination of cards includes a wild card. For example, a hand containing four Tens and a hand containing three Tens and a wild card, which substitutes as a Ten, pay the same winnings. Thus, wild cards increase the likelihood of a player obtaining a winning hand but do not increase the amount awarded for a winning hand. Since the likelihood of obtaining winning hands is increased by wild cards, the payout for winning hands is adjusted or lowered as compared to poker machines which do not include wild cards.

Some electronic poker gaming apparatus permit a player to be eligible for a progressive jackpot in addition to the amount normally awarded for winning a poker hand. Such progressive jackpot gaming apparatus generally include a plurality of electronic poker gaming apparatus electrically linked in a carousel formation to a progressive jackpot meter, which monitors the jackpot amount. The jackpot amount is continuously increased, usually in proportion to the number of games played at the linked gaming machines, until a player wins the jackpot, at which time the jackpot meter is reset. A player who wins a poker game with a predetermined winning combination of cards is awarded winnings for the hand as well as the progressive jackpot.

Although these prior gaming apparatus provide enjoyment to players and encourage players to continue to play, novel electronic poker gaming apparatus with bonus incentives are desirous to offer players a variety of gaming and entertainment options.

Accordingly, it is therefore a general object of the invention to provide an apparatus and method for playing an electronic poker game which potentially increases the value of a winning hand and thus adds excitement to the game.

It is a specific object of the invention to provide an apparatus and method of playing an electronic poker game which is entertaining, encourages continued play, and is simple to play by a novice user.

It is another object of the invention to provide an apparatus and method of playing an electronic poker game which may be adapted to enable play of any variation of a poker-type game.

It is a still another object of the invention to provide an apparatus and method of playing an electronic poker game which presents new strategy opportunities to a player, thereby increasing the mentally challenging aspects of a poker game.

DISCLOSURE OF INVENTION

A preferred embodiment of the invention which is intended to accomplish at least some of the foregoing objects includes an electronic poker game apparatus having user-actuated input assembly for play of a poker game. An electronic game control device, programmed to simulate play of a poker game, is electrically connected to the input assembly to receive and respond to commands entered by a player into the gaming apparatus. A display screen is also electrically coupled to the game control device for visually displaying the progress of the poker game.

The game control device generally comprises a microprocessor electrically connected to a memory device which stores the gaming system program and instructions, as well as data entered by the player. The game control device also includes a signal generator for generating a plurality of signals representing randomly selected cards from a deck of cards to form a poker hand. A bonus signal generator is electrically connected to the game control device and responds to the selection of a predetermined signal representing a predetermined card by randomly effecting one of (i) replacement of the predetermined signal with a bonus signal and (ii) retention of the predetermined signal in accordance with odds less than unity. The display screen visually displays card symbols corresponding to the randomly selected signals, and, upon presence of a bonus signal, visually displays a bonus card symbol.

An associated method of playing an electronic poker game in accordance with a preferred embodiment of the present invention includes providing a poker gaming apparatus including user-actuatable input assembly, an electronic game control device, a display screen, and a bonus signal generator. A player enters commands into the game control device via the input assembly to play a game of poker. The game control device randomly generates a plurality of signals representing randomly selected cards from a deck of cards to create a poker hand in response to player input. Upon the presence of a predetermined signal, the bonus signal generator randomly effects one of replacement and retention of the predetermined signal in accordance with odds less than unity. Upon replacement of the predetermined signal, the bonus signal generator replaces the predetermined signal with a bonus signal. The game control device visually displays cards represented by the randomly selected signals on the display screen and, upon the replacement of the predetermined signal, displays a bonus card corresponding to the bonus signal. In a preferred embodiment, if the selected poker hand contains a predetermined game winning combination of cards and the bonus card represented by the bonus signal forms part of the game winning combination, then a player is awarded a bonus amount in addition to the amount normally awarded for the game winning combination of cards.

BRIEF DESCRIPTION OF THE DRAWING

Other objects and advantages of the present invention will become apparent from the following detailed description of a preferred embodiment thereof taken in conjunction with the accompanying drawings.

BEST MODE OF CARRYING OUT THE INVENTION

Figure 1:
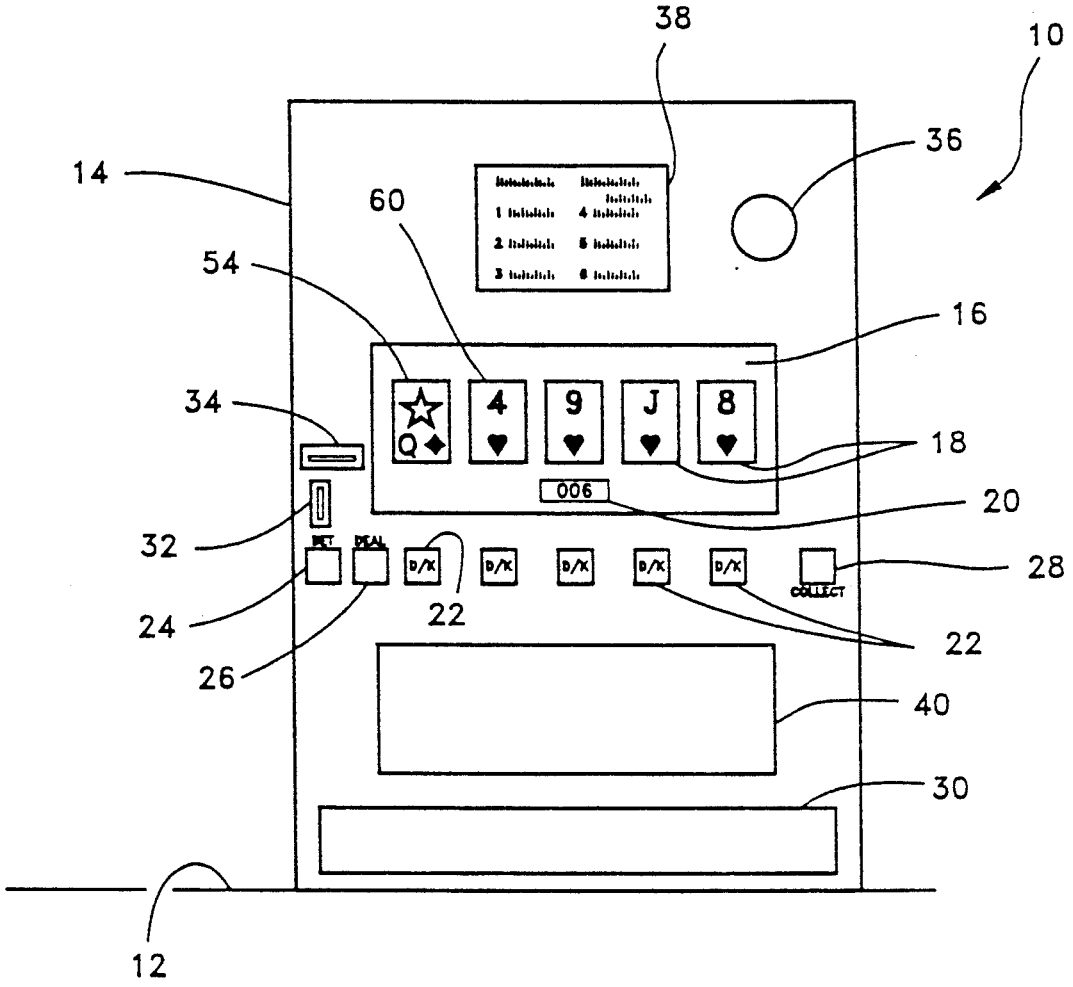
FIG. 1 is a front elevation view of a schematic representation of an electronic poker gaming apparatus constructed in accordance with the present invention for play of a poker game.

Referring now to the drawings, wherein like numerals indicate like parts, and initially to FIG. 1, there will be seen an electronic poker gaming apparatus 10 constructed in accordance with a preferred embodiment of the invention. Poker gaming apparatus 10 is designed to permit a player with a game winning combination of cards to be eligible for bonus winnings. Briefly, if a player's winning hand includes a bonus card, and the bonus card forms part of the winning combination of cards, then the player is awarded bonus winnings in addition to the normal winnings for the poker hand. Play of poker gaming apparatus 10 will be more fully described below; however, a general description of the components of the apparatus may be helpful to better understand the operation of the apparatus in connection with a bonus poker game. The gaming apparatus will be described in terms of a conventional "draw poker" gaming apparatus, but it will be understood that other variations of poker may be played on the subject gaming apparatus.

Game apparatus 10 is preferably placed on a support counter 12 for play by a player while standing or seated on a stool, similar to a typical slot machine gaming station. It will be understood that bar-top and slant top versions or formats can also be employed. A conventional electronic poker display 16 is mounted to game apparatus housing 14. Poker display 16 usually consists of a video screen upon which card images 18 can be depicted. In this embodiment of the subject invention, five cards are displayed; however, it will be understood that more or fewer card images may be displayed in alternative gaming apparatus in accordance with variations of poker-type games, such as seven-card draw poker. Display screen 16 also typically includes a window 20 upon which the number of coins available for betting is indicated.

Discard/keep or "D/K" buttons 22 (also sometimes designated "hold/cancel" buttons) are provided adjacent each card image 18 on game apparatus 10 for user actuation to effect either discarding or keeping of an associated card. "Bet" and "deal" buttons 24 and 26, respectively, are also provided on game apparatus 10 for use by a player to play the poker game. Gaming apparatus 10 also includes a "collect" button 28 for permitting a player to cash-out his winnings. Pushing "collect" button 28 causes the number of coins indicated in window 20 to drop into coin tray 30.

It will be appreciated that, as an alternative to input buttons 22, 24, 26, and 28, video display screen 16 itself may serve as an input device. For this purpose, video display screen may consist of a touch screen with capacitive sensors, or may be actuated by a light pen or a similar user-actuatable input device.

Other standard components found on gaming apparatus 10 may include coin or token slot 32 used to place bets (a paper currency slot also may be provided), credit card reader 34 for placing bets with a credit or banking card, a speaker 36 for audio output associated with game play, rules panel 38 with brief rules and information relating to game play, and a "belly panel" for graphics, such as the name of the game.

Figure 2:
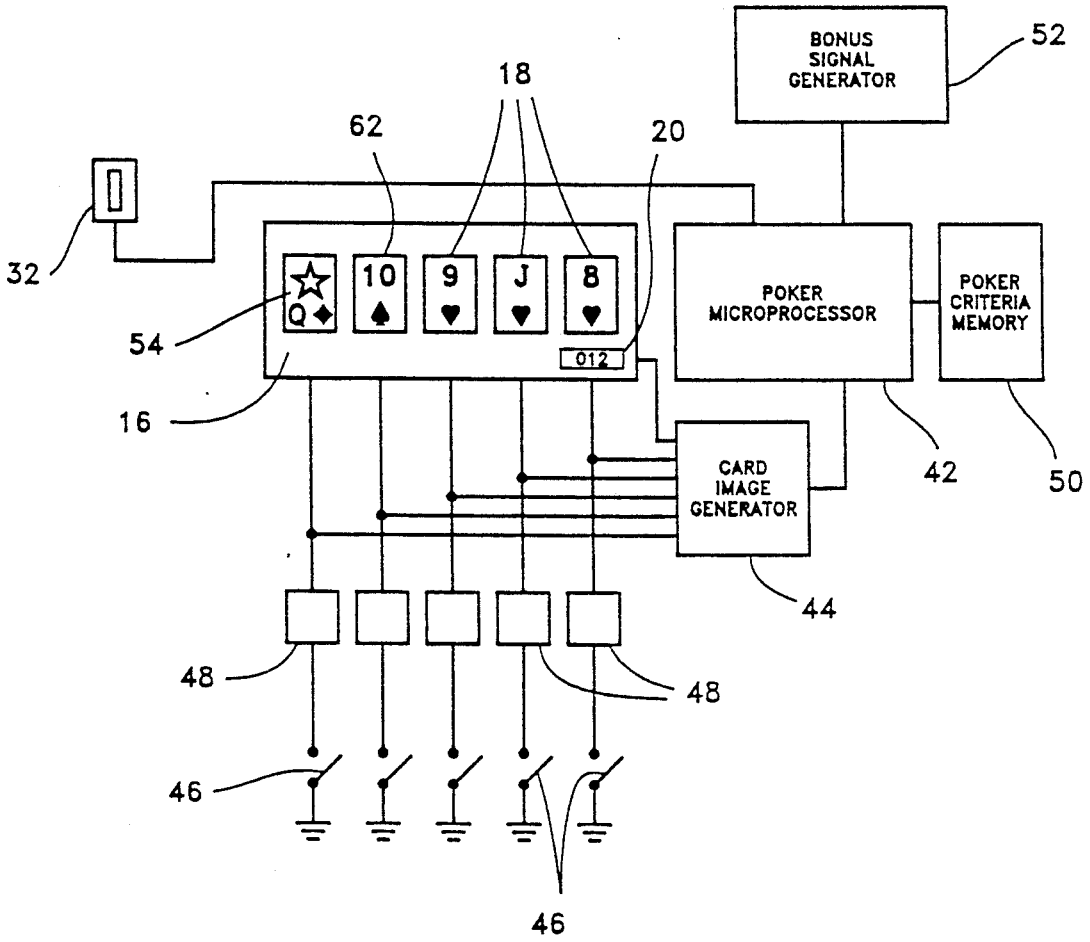
FIG. 2 is a schematic representation of the circuitry of the electronic poker gaming apparatus of FIG. 1 and illustrates a poker hand entitled to bonus winnings in accordance with the present invention.

Turning to FIG. 2, the circuitry associated with the electronic poker gaming apparatus of the present invention is illustrated. Electronic game device includes microprocessor 42 which serves as the controller for the game apparatus. Microprocessor 42 is electrically connected to card image generator 44 for controlling simulation of card images on screen 16. Discard and keep buttons 22, which are schematically represented by boxes 48, are electrically coupled through switch logic, generally indicated 46, to card image generator 44 and screen 16. It will be appreciated that switches 46, image generator 44, and screen 16 can be connected in parallel or series or electrically coupled with a combination of series and parallel circuits.

Microprocessor 42 also electrically communicates with memory device 50. Memory device 50 includes ROM storage for storing the system program and instructions and RAM storage for storing data entered into gaming apparatus 10 by a player. A plurality of game winning poker combinations are stored in ROM memory, and a typical schedule of winning combinations might be as follows, from those awarding highest to lowest winnings: Royal Flush, Straight Flush, Four-of-a-Kind, Full House, Flush, Straight, Three-of-a-Kind, and Two Pair. As will be appreciated, other hands may be included in the schedule, such as a Pair of Tens or better and Five-of-a-Kind, if wild cards are included in the deck. Generally, a predetermined amount of winnings corresponding to each winning poker hand is also stored in memory device 50. In an alternative embodiment, however, the amount of winnings may double or increase in the same manner as seen in conventional progressive jackpot gaming apparatus.

In order to provide a new dimension in game strategy and to greatly enhance the entertainment value of playing a poker gaming apparatus, game apparatus 10 of the present invention also includes a bonus signal generator 52 electrically coupled to microprocessor 42. As will be explained fully below, bonus signal generator 52 randomly selects between replacing a predetermined signal generated by microprocessor 42 with a bonus signal and retaining the predetermined signal in accordance with known odds less than unity.

Production of a bonus signal may entitle a player to bonus winnings.

The electronic gaming apparatus of the present invention can be formed using electronic components that are conventional and in widespread use in prior gaming apparatus. There are many combinations of components which will be satisfactory to produce the game apparatus of the present invention, and one skilled in the art of the logic and circuit design can readily make a selection of the same to implement the gaming apparatus as described herein.

Having described the basic components of the poker gaming apparatus, play of the gaming apparatus will now be described. In order to begin play of a poker game, a player inserts coins or tokens into slot 32, or paper currency into a currency slot (not shown), to place a bet. Once the desired number of coins or tokens have been inserted, the player may push "deal" button 26 which sends a signal to microprocessor 42 to generate a plurality of signals representing cards randomly selected from a card deck. Five signals are typically randomly generated to represent five cards from a standard deck of fifty-two cards to create a poker hand. More cards may be present in the electronic deck, however, if the particular poker game involves wild cards.

Microprocessor 42 then compares each randomly selected signal to a predetermined signal stored in memory 50. If one of the randomly selected signals matches the predetermined signal, microprocessor 42 electrically communicates with and directs bonus signal generator 52 to randomly effect one of replacing the predetermined signal with a bonus signal or retaining the predetermined signal in accordance with known odds.

Bonus signal generator 52 preferably replaces the predetermined signal with a bonus signal about one time in a predetermined number of occurrences, for example, in the range of one in 20 to one in 150. This replacement rate can be selected and changed depending upon the desired payout.

Once bonus signal generator 52 makes a selection between replacing and retaining the predetermined signal, microprocessor 42 responds to the selection and transmits the randomly selected signals and either the predetermined signal or the bonus signal, depending on the selection made by bonus signal generator 42, to card image generator 44. Card symbols corresponding to these transmitted signals are simulated by generator 44 on screen 16. So, if a predetermined signal is present in the plurality of signals randomly generated by microprocessor 42, then either a card symbol corresponding to the predetermined signal or a bonus card symbol corresponding to the bonus signal will be displayed on screen 16.

The identity of the predetermined signal is stored in ROM memory 50, and, in a preferred embodiment, the predetermined signal is a signal which would produce the display of a Queen of any suit. However, in alternative embodiments, the predetermined signal may be limited to a Queen of a particular suit or may represent a different face card, or any other preselected card in the deck. According to the preferred embodiment of the present invention, if a signal representing a Queen is randomly selected by microprocessor 42, microprocessor 42 would then direct bonus signal generator 52 to select between retaining the "Queen signal" or replacing the "Queen signal" with a "Bonus Queen signal." FIG. 1 illustrates a poker hand where card image generator 52 has selected to replace the signal corresponding to the Queen of Diamonds with a bonus signal representing a Bonus Queen of Diamonds and, thus, a bonus card symbol 54 representing the Bonus Queen of Diamonds appears on display screen 16. It will be understood that the bonus symbol 54 may be the logo or any desired symbol of the owner of the apparatus.

A bonus signal preferably produces a card representation including bonus indicia and indicia representing the same suit and the same card value as the predetermined signal which the bonus signal replaces. This is desirable so as not to affect the odds of attaining a game winning combination of cards. However, it will be understood that the bonus signal also may represent a wild card having any card value and any suit in an alternative embodiment of the subject poker gaming apparatus.

After the poker hand has been electronically dealt, the player may elect to discard or keep each of the cards by actuating "D/K" buttons 22 associated each card symbol 18. Depending upon the computer logic stored in microprocessor 42, depressing "D/K" button 22 will discard a card and not depressing the button will keep the card. If a card is erroneously discarded, depressing the same button again will restore the discarded card.

Once the player has made a decision with respect to discarding or keeping each card, the player again pushes "deal" button 26. Microprocessor 42 then randomly selects signals representing cards present in the remainder of the deck. If no bonus signal has been produced by this time, microprocessor 42 again compares the randomly selected signals to the predetermined signal and, if a match is found, bonus signal generator 52 effects either replacement of the predetermined signal with a bonus signal or retention of the predetermined signal. Microprocessor 42 then replaces the discarded cards with images of the newly selected cards to complete the poker game.

After the "draw", microprocessor 42 then compares the selected signals to game winning criteria stored in memory 50 to determine whether the selected signals represent a winning poker hand. If the selected signals generated by microprocessor 42 match any of the predetermined game winning combination of signals in memory 50, microprocessor 42 credits or pays out the stored winnings amount. If no match is found, the poker game ends, and microprocessor 42 resets for initiation of another game.

In the event the selected signals produce a game winning combination of signals, microprocessor 42 also determines if the selected signals include a bonus signal. In a preferred embodiment, if a bonus signal is present and forms part of the game winning combination of signals, microprocessor 42 adds a predetermined bonus amount to the predetermined amount of winnings for the winning combination of signals. For example, a player playing the gaming apparatus of FIG. 2 would receive bonus winnings for the Bonus Queen 54 in addition to the normal winnings accorded a Straight since Bonus Queen 54 forms part of the Straight. A player preferably earns double the normal winnings for a hand containing a bonus card in the game winning combination.

Upon completion of the game, poker gaming apparatus will pay or credit the player for a winning hand, including any bonus winnings. Most typically, the number of coins available will be visually indicated on a video screen at window 20, and the player will have the option of being able to collect the coins by pushing "collect" button 28, which releases coins into token tray 30, or pushing "bet" button 24 to bet on a new hand.

Figure 3:
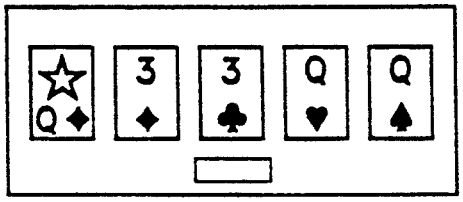
FIG. 3 is a schematic representation of a video screen of the present invention illustrating a winning poker hand entitled to bonus winnings in accordance with the present invention.
Figure 4:
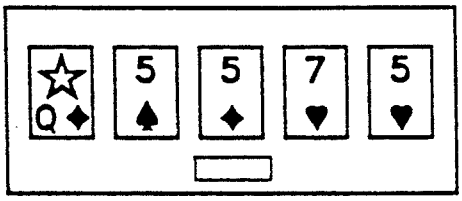
FIG. 4 is a schematic representation of a video screen of the present invention illustrating a winning poker hand which is not entitled to bonus winnings.

As indicated above, gaming apparatus of the present invention offers an additional bonus incentive of allowing players to be eligible for bonus winnings in excess of the predetermined winnings accorded a winning poker hand. In the preferred embodiment, if a bonus card is present in the winning poker hand and forms part of the winning combination, then the player receives bonus winnings in addition to the winnings normally awarded for the combination. For example, the winning combination of cards in FIG. 3 comprises a Full House. Since the Bonus Queen 56 forms part of the Full House, bonus winnings are awarded to the player. On the other hand, FIG. 4 illustrates a winning combination of Three of a Kind where the bonus card does not form part of the winning combination. Since Bonus Queen 58 is not part of the winning combination of three Fives, the player is only entitled to the winnings accorded a Three of a Kind.

Play of the poker gaming apparatus of the subject invention involves different game strategy than play of a conventional poker gaming apparatus. By way of example, a player dealt the poker hand shown in FIG. 1 has the option of either discarding the Bonus Queen 56 and playing for a Flush or discarding the Four of Hearts 60 and playing for a Straight. The probability of obtaining a Flush (9 hearts in 47 remaining cards) is markedly greater than the probability of obtaining a Straight (4 tens in 47 remaining cards). However, a player, enticed by the prospect of earning bonus winnings, may choose to discard the Four and play for the Straight, as shown in FIG. 2 where microprocessor 42 has randomly dealt a Ten of Spades 62 to replace the discarded Four. Thus, the addition of a bonus incentive in a poker gaming apparatus adds to the strategy, excitement and mental challenge of the poker game.

Although a preferred embodiment of the game permits a player to obtain only one bonus card per game, microprocessor 42 may be programmed to permit a player to obtain more than one bonus card in a hand. For example, more than one, and possibly all three, of the Queens present in the poker hand of FIG. 3 could be replaced by Bonus Queens, provided bonus signal generator 52 selects to replace each "Queen signal" with a "Bonus Queen signal." In this alternative embodiment, if all three Queens were replaced with Bonus Queens, a player would receive bonus winnings which had been doubled three times.

In describing the invention, reference has been made to a preferred embodiment and illustrative advantages of the invention. Those skilled in the art, however, and familiar with the instant disclosure of the subject invention, will recognize additions, deletions, modifications, substitutions, and other changes which will fall within the purview of the subject invention and claims.

What is claimed is:

1. An electronic poker gaming apparatus comprising:

user-actuatable input means;

electronic game control means connected to said input means and responsive to user input to simulate play of a poker game, said game control means including a random signal generating means for generating a plurality of signals representing a plurality of randomly selected cards from a deck of cards for creation of a poker hand;

bonus signal generator means electrically connected to said game control means and responsive to the selection of a predetermined one of said signals representing a predetermined card to randomly effect one of:

(i) replacement of said predetermined one of said signals with a bonus signal, and (ii) retention of said predetermine one of said signals, said bonus signal generator randomly effecting one of replacement and retention in accordance with known odds less than unity; and display means electrically connected to said game control means for visual display of card symbols corresponding to the randomly selected signals and, upon the presence of said bonus signal, visual display of a bonus card symbol, and wherein, said game control means includes game winning criteria means responsive to completion of selection of said randomly selected signals to compare said randomly selected signals against predetermined game winning combinations of signals and to produce an poker hand signal in response to said randomly selected signals matching one of said predetermined game winning combinations of signals, said poker hand signal produced by said game winning criteria means including a common amount when said bonus signal is present and said randomly selected signals matches one of said predetermined game winning combinations of signals, and said game winning criteria means produces said poker hand signal including said bonus amount only when said bonus signal is present in and forms a part of one of said predetermined game winning combinations of signals.

2. An electronic poker gaming apparatus as defined in claim 1 wherein, said bonus signal produces a card representation including bonus indicia and indicia representing the same suit and the same card value as said predetermined one of said signals which said bonus signal replaces.

3. An electronic poker gaming apparatus as defined in claim 1 wherein, said bonus signal generator means is formed to effect replacement of said predetermined one of said signals about one time in every twenty to one hundred fifty occurrences of said redetermined one of said signals.

4. An electronic poker gaming apparatus as defined in claim 1 wherein, said predetermined one of said signals represents at least one of four Queens contained in said deck of cards.

5. An electronic poker gaming apparatus comprising:

user-actuatable input means;

electronic game control means connected to said input means and responsive to user input to simulate play of a poker game, said game control means including a random signal generating means for generating a plurality of signals representing a plurality of randomly selected cards from a deck of cards for creation of a poker hand;

bonus signal generator means electrically connected to said game control means and responsive to the selection of a predetermined one of said signals representing a predetermined card to randomly effect one of:

(i) replacement of said predetermined one of said signals with a bonus signal, and (ii) retention of said predetermine one of said signals, said bonus signal generator randomly effecting one of replacement and retention in accordance with known odds less than unity; and display means electrically connected to said game control means for visual display of card symbols corresponding to the randomly selected signals and, upon the presence of said bonus signal, visual display of a bonus card symbol, and wherein, said game control means includes game winning criteria means responsive to completion of selection of said randomly selected signals to compare said randomly selected signals against predetermined game winning combinations of signals and to produce an poker hand signal in response to said randomly selected signals matching one of said predetermined game winning combinations of signals, said poker hand signal produced by said game winning criteria means including a common amount when said bonus signal is present and said randomly selected signals matches one of said predetermined game winning combinations of signal, and said game winning criteria means produces said poker hand signal including said bonus amount only when said bonus signal is present in and forms a part of one of said predetermined game winning combinations of signals, and wherein further, in the event said bonus signal generator means produces a bonus signal corresponding to a bonus card symbol, said predetermined winning combinations paying bonus winnings include Three of a Kind composed of three identical value cards including said bonus card, Four of a Kind composed of four identical value cards including said bonus card, a Flush where said bonus card has the same suit as the remaining cards, a Straight where said bonus card has a value in sequence with the remaining cards, a Full House where said bonus card has a value identical to the value of at least one other card, and a Straight Flush were said bonus card has a value in sequence with, and the same suit as, the remaining cards.

6. An electronic poker gaming apparatus comprising:

user-actuatable input means;

electronic game control means electronically communicating with and responsive to said input means to enable play of a poker game, said game control means including a signal generating means for generating a plurality of signals representing a plurality of randomly selected cards from a deck of cards to create a poker hand;

bonus signal generator means electrically connected to said game control means and responsive to the selection of a predetermined one of said signals to randomly effect one of:

(i) replacement of said predetermined one of said signals with a bonus signal, and (ii) retention of said predetermine one of said signals, said bonus signal generator randomly effecting one of replacement and selection in accordance with known odds less than unity;

display means for indicating the progress of the poker game, said display means electrically connected to said game control means for visual display of card symbols corresponding to the randomly selected signals and, upon the presence of said bonus signals, visual display of bonus card symbol corresponding to said bonus signals; and said bonus signals entitling a user to bonus winnings where the bonus cards represented by said bonus signals form a part of a winning combination of cards in the poker hand.

7. A method of playing an electronic poker game comprising the steps of:

providing a poker gaming apparatus including user-actuatable input means, bonus signal generator means, and electronic game control means electrically connected to said input means and said display means and said bonus signal generator means;

generating a random selection of a plurality of signals representing a plurality of randomly selected cards from a deck of cards for playing a poker game by said game control means in response to an input by a user;

upon the presence of a predetermined signal in said randomly selected signals, randomly effecting one of replacement and retention of said predetermined signal in accordance with odds less than unity by said bonus signal generator means in response to said generating step;

upon replacement of said predetermined signal, replacing said predetermined signal with a bonus signal; and visually displaying cards represented by said randomly selected signals and, upon replacement of said predetermined signal, displaying a bonus card corresponding to said bonus signal, wherein, after said generating step and said step of randomly effecting one of replacement and retention, comparing the selected poker hand against winning poker hands stored in memory of said game control means to determine whether said selected poker hand is a winning poker hand; and if said selected poker hand is a winning poker hand, causing one of crediting and paying out a predetermined amount of winnings to the user as stored in said memory of said game control means and corresponding to said winning poker hand, and wherein, in the event said selected poker hand is a winning poker hand, determining if said selected poker hand also contains a bonus card by said game control means; and if said selected poker hand contains said bonus card, adding predetermined bonus winnings to said predetermined amount of winnings for said winning poker hand, and wherein further, said adding step is accomplished only in the event that said bonus card comprises a part of said winning poker hand.

8. A method of playing an electronic poker game as defined in claim 7 wherein, said adding step is accomplished by adding a bonus amount approximately equal to said predetermined amount of winnings for said winning poker hand.

* * * * *

UNITED STATES PATENT AND TRADEMARK OFFICE

CERTIFICATE OF CORRECTION

PATENT NO. : 5,332,219

DATED : July 26, 1994

INVENTOR(S) : Anthony A. Marnell, II, et al

It is certified that error appears in the above-indentified patent and that said Letters Patent is hereby corrected as shown below:

At Column 8, line 48, delete the word "common" and replace it with --bonus--.

At Column 9, line 2, delete the word "redetermined" and replace it with --predetermined--.

At Column 9, line 43, delete the word "common" and replace it with --bonus--.

At Column 9, line 46, delete the word "signal" and replace it with --signals--.

At Column 9, line 64, delete the word "were" and replace it with --where--.

UNITED STATES PATENT AND TRADEMARK OFFICE

CERTIFICATE OF CORRECTION

PATENT NO. : 5,332,219

DATED : July 26, 1994

INVENTOR(S) : Anthony A. Marnell, II, et al

It is certified that error appears in the above-indentified patent and that said Letters Patent is hereby corrected as shown below:

At Column 10, line 12, delete the word "one" and replace it with --ones--.

At Column 10, line 11, delete the word "a", and delete the word "signal" and replace it with --signals--.

Signed and Sealed this

Fourth Day of October, 1994

*Attest:*

Bruce Lehman

BRUCE LEHMAN

*Attesting Officer*

*Commissioner of Patents and Trademarks*